United States Patent [19]

Jacobs et al.

[11] 4,336,102

[45] Jun. 22, 1982

[54] METHOD FOR RECOVERY AND REUSE OF AMMONIA IN AMMONIA-BASE SULFITE COOKING LIQUORS

[75] Inventors: Lawrence J. Jacobs, East Hartford; Carl R. Bozzuto, Enfield, both of Conn.

[73] Assignee: Combustion Engineering, Inc., Windsor, Conn.

[21] Appl. No.: 194,360

[22] Filed: Oct. 6, 1980

[51] Int. Cl.[3] ..... D21C 11/02

[52] U.S. Cl. ..... 162/30.1; 162/36; 210/670; 210/928; 423/356; 423/DIG. 3

[58] Field of Search ..... 162/36, 29, 37, 38, 162/30 R, 15, 16, 30.1, 86; 210/681, 928, 670; 423/DIG. 3, 356, 541 A

[56] References Cited

U.S. PATENT DOCUMENTS 2,736,635 2/1956 Haywood ..... 162/36

2,778,714 1/1957 Kasper et al. ..... 162/29

2,947,656 8/1960 Bailey ..... 162/36

3,095,265 6/1963 Effer et al. ..... 423/DIG. 3

*Primary Examiner*—Steve Alvo

*Attorney, Agent, or Firm*—Fishman and Van Kirk

[57] ABSTRACT

A method for recovering ammonia from spent ammonia-base sulfite pulping liquor includes steam stripping spent ammonia and condensing the resulting vapor to produce a dilute ammonia or ammonium hydroxide solution. This dilute solution is passed through a cation exchange column to produce an ammonium sulfite-ammonium bisulfite solution which is delivered to a sulfur dioxide absorption tower to thereby produce a concentrated ammonia-base sulfite cooking liquor. The residual liquor from the stripping step and the non-condensable gases are burned as fuel and the waste gases from this burning, which contain a small percentage of sulfur dioxide, are delivered to the absorption tower and subsequently discharged to the atmosphere free of sulfur dioxide and ammonia.

4 Claims, 1 Drawing Figure

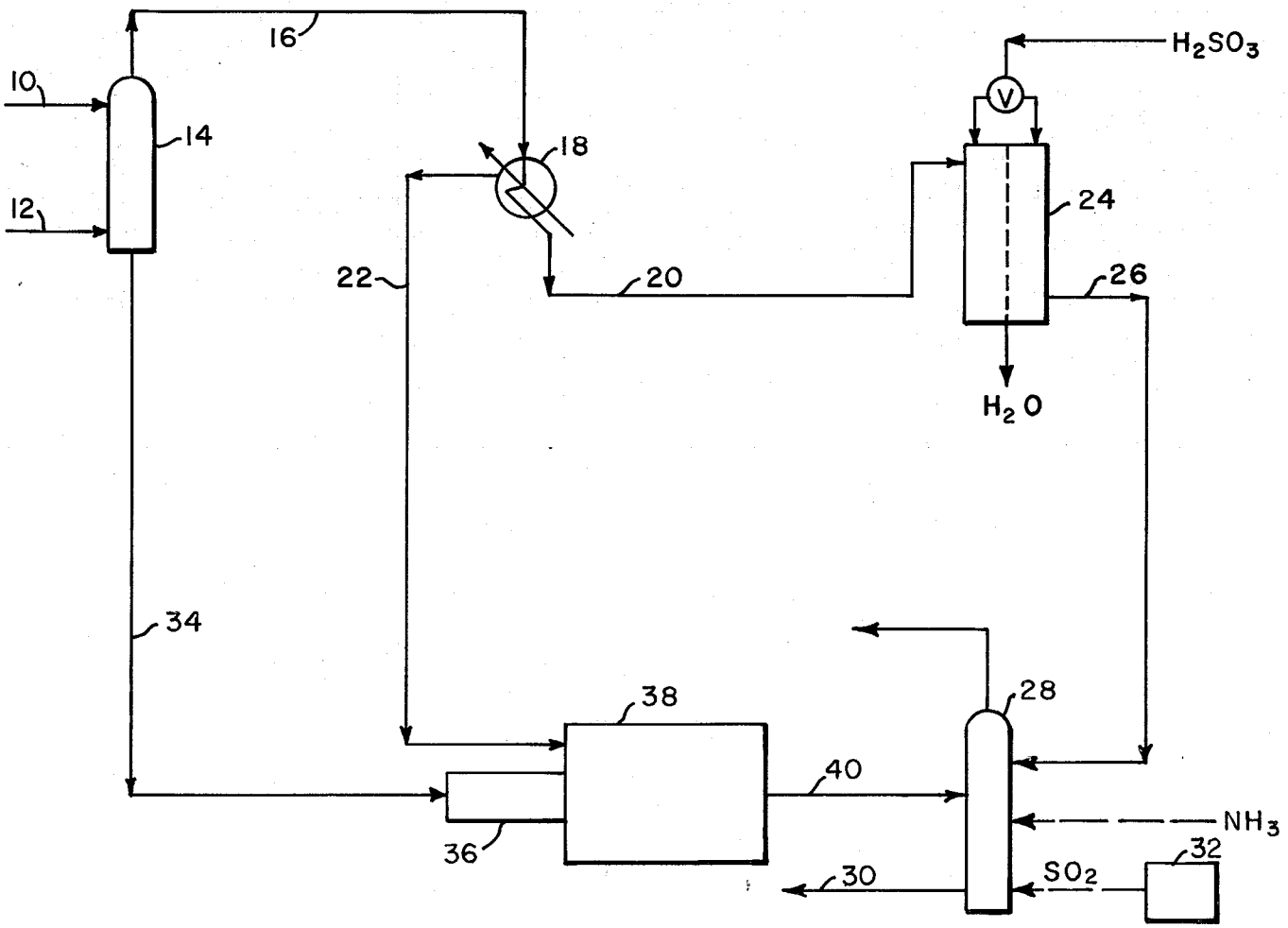
$H_2SO_3$
24
26
$H_2O$
$NH_3$
32
$SO_2$
28
30
40
38
36
18
20
22
16
14
34
10
12

METHOD FOR RECOVERY AND REUSE OF AMMONIA IN AMMONIA-BASE SULFITE COOKING LIQUORS

BACKGROUND OF THE INVENTION (1) Field of the Invention

The present invention relates to an improved method for recovering ammonia from spent ammonia-base sulfite pulping liquor. Specifically, this invention is directed to a process whereby ammonia is recovered from spent ammonia-based pulping liquor and converted into a concentrated cooking liquor comprising ammonium bisulfite and ammonium sulfite for use in the digester of a pulping plant. Accordingly, the general objects of the present invention are to provide novel and improved methods of such character.

(2) Description of the Prior Art

One method of producing pulp, for papermaking, involves dissolving the ligneous and other non-celluosic substances of the wood with acidic or neutral liquors. Those liquors are generally comprised of sulfite and a base element such as calcium, magnesia, sodium or ammonia. The use of ammonia as the basic element in the "cooking liquor" has the advantage of producing a shorter cooking time in comparison with the use of calcium as the basic element. Ammonia-base sulfite pulping is also advantageous since it is the least capital intensive pulping process and is the most acceptable from an environmental standpoint. However, ammonia is a comparatively expensive raw material and it is difficult to recover the ammonia from the spent liquor. A further disadvantage inherent in the use of ammonia is the necessity of preventing the discharge thereof into the environment; this problem also dictating that the ammonia be recovered from the spent cooking liquor.

U.S. Pat. No. 3,864,192 to Copeland reveals a typical prior art process for the treatment of spent ammonia-base pulping liquor. In this patent the spent liquor is converted, in part or entirely, to a magnesium-base sulfite waste liquor by mixing ammonia-base liquor with hot gases, at about 1600° F., containing magnesia particles. The resulting magnesia-base bisulfite waste is then concentrated and burned to produce the magnesia particles. In the process of U.S. Pat. No. 3,864,192, sulfur dioxide but not ammonia is recovered and very high temperatures must be maintained in order to produce the magnesia particles.

U.S. Pat. No. 3,598,695 to Waterstradt purports to disclose a prior art technique for recovering ammonia from ammonia-base pulping liquor. In the process of this patent the ammonia-base spent liquor is first combined with sulfuric acid to effectuate the release of sulfur dioxide. Subsequently, a sodium hydroxide solution is added to the spent liquor to effectuate the release of ammonia. A principle disadvantage of the technique of U.S. Pat. No. 3,598,695 is the requirement for the use of two reagents; i.e., sulfuric acid and sodium hydroxide; to serially effectuate the release of sulfur dioxide and ammonia.

SUMMARY OF THE INVENTION

The present invention overcomes the above-discussed and other deficiencies and disadvantages of the prior art by providing a novel method for the recovery of ammonia from spent ammonia-base sulfite pulping liquor. The technique of the present invention is more efficient and less expensive to practice when compared to the prior art.

In accordance with the preferred embodiment of the present invention, a dilute distillate of ammonia or ammonium hydroxide in water is first produced by steam stripping the spent ammonia-based sulfite liquor and subsequently cooling the vapor to a temperature within the range of 80°–110° F. by passing the vapor through a condenser. The dilute distillate is then passed through a cation exchange column which has previously been charged with sulfurous acid on the cation sites. The solution discharged from the cation exchange column is principally comprised of ammonium bisulfite or ammonium sulfite. This solution is passed through a sulfur dioxide fortifying tower where it is converted into a concentrated ammonia-base sulfite cooking liquor which is returned to the digester.

Also in accordance with the preferred embodiment of the present invention, the heavy liquor remaining after the steam stripping step is delivered, along with the non-condensable gases which exit the condenser, to a standard steam generator for burning. The exhaust gases from this steam generator, which contain small percentages of sulfur dioxide, are passed through the sulfur dioxide fortifying tower and may thereafter be discharged to the atmosphere free of any sulfur dioxide and ammonia. The exhaust gases can also be scrubbed with water to form a sulfurous acid solution for use in regenerating the cation exchange column. The choice would depend upon the overall sulphur balance in the plant.

BRIEF DESCRIPTION OF THE DRAWING

The present invention may be better understood and its numerous objects and advantages will be apparent to those skilled in the art by reference to the accompanying drawing which is a flow diagram depicting practice of the present invention.

DESCRIPTION OF THE PREFERRED EMBODIMENT

Referring to the drawing, spent ammonia-base sulfite pulping liquor from a digester is pumped through a conduit 10 into a stripping tower 14. A supply of low pressure steam is injected into stripping tower 14 through conduit 12. The distillation process within stripping tower 14 is continued by maintaining a vacuum on the order of 10–15 inches of Hg. The vapor produced therein is removed from stripping tower 14 by suitable means, a small fan for example, via conduit 16. This vapor will typically comprise ammonia, water, reduced sulfur compounds and sulfur dioxide.

The vapor which exits stripping tower 14 is passed through condenser 18 which lowers the temperature of the vapor to the range of 80°–110° F. This reduction in temperature causes the formation of a distillate solution primarily comprised of ammonia or ammonium hydroxide in water.

The distillate solution is delivered from condenser 18 to a cation exchange column 24 via conduit 20. The cation exchange column 24 will include a cation (acid) base resin and will have been previously charged with sulfurous acid on the cation sites. Accordingly, because of the reaction which takes place within the cation exchange column, a solution of ammonium bisulfite and ammonium sulfite will be discharged therefrom into conduit 26; waste water also being discharged from cation exchange column 24. It is to be noted that in actual practice there will be a plurality of cation exchange columns. Accordingly, when one column is discharging; i.e., reacting with the distillate solution from condenser 18 in the exchange mode; another column may be regenerated or charged by the delivery of $H_2SO_3$ thereto. The switching between cation exchange columns may be accomplished automatically by sensing the pH of the solution exiting the column into conduit 26.

The ammonium bisulfite-ammonium sulfite solution discharged from the cation exchange column flows into a sulfur dioxide fortifying tower 28. Fortifying tower 28 may also receive makeup $NH_3$ from a source, not shown, $SO_2$ from a sulfur burner 32 and flue gas which includes $SO_2$ from a boiler 38. The solution of ammonium bisulfite and ammonium sulfite is converted to a concentrated cooking liquor within fortifying tower 28 and discharged to the digesters, not shown, through conduit 30. The fortifying tower 28 may, for example, comprise a tray type absorber.

The above-mentioned flue gases are produced as follows. The residual liquor from stripping tower 14 is transported via conduit 34 to a conventional steam generator 36. Steam generator 36 may, for example, comprise a Loddby furnace which functions as a preburner for a waste heat boiler 38. The exhaust products from steam generator 36, as well as the non-condensable gases from condenser 18, which flow through conduit 22, are mixed and burned in waste heat boiler 38. Thus, both the non-condensable gases and the residual liquor or "heavies" from the stripping tower are burned as fuel and the exhaust gases thus generated are discharged into fortifying tower 28 through conduit 40. These exhaust gases typically consist of 80% nitrogen, 13% carbon dioxide, 1% oxygen, 1–2% sulfur dioxide with the remainder being water vapor.

The exhaust gases, after passing through the fortifying tower 28, are discharged to the atmosphere. The sulfur dioxide content of the gases thus discharged is sensed and, if too high, the bisulfite-sulfite solution flow rate to fortifying tower 28 will be increased to thereby insure that the plant discharge contains no more than the maximum permissible quantity of $SO_2$.

Similarly, the pH of the concentrated cooking liquor being delivered from fortifying tower 28 to the digester is sensed. If the pH of this concentrated liquor is too high $NH_3$ will be lost out of the top of the fortifying tower. In order to prevent this ammonium loss, the sensed pH is employed to control the operation of the sulfur burner 32 whereby additional $SO_2$ will be delivered to the fortifying tower as necessary to prevent such $NH_3$ loss.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A process for the recovery and reuse of ammonia in ammonia-base sulfite cooking liquors comprising the steps of:

steam stripping spent ammonia-base sulfite cooking liquor to produce a vapor and a liquor residue;

condensing the vapor formed during the steam stripping to form a dilute aqueous solution comprising ammonia or ammonium hydroxide in water;

burning the liquor residue produced during steam stripping and non-condensed gases from the condensing step to produce an exhaust gas containing sulfur dioxide;

passing the dilute aqueous solution produced during the condensing step through a cation exchange column charged with sulphurous acid to thereby form an ammonium sulfite containing solution;

delivering the exhaust gases produced during the step of burning and the ammonium sulfite containing solution to a fortifying tower; and fortifying the ammonium sulfite containing solution with sulfur dioxide from the exhaust gases of the burning step to produce an ammonia-based sulfite cooking liquor concentrate.

2. The process of claim 1 further comprising:

delivering make-up ammonia to the fortifying tower.

3. The process of claim 2 further comprising:

burning a sulfur containing material to produce additional sulfur dioxide; and delivering the additional sulfur dioxide to the fortifying tower.

4. The process of claim 1 further comprising:

burning a sulfur containing material to produce additional sulfur dioxide; and delivering the additional sulfur dioxide to the fortifying tower.

* * * * *